United States Patent [19]

Itoh et al.

[11] 4,115,111

[45] Sep. 19, 1978

[54] FREE-CUTTING STRUCTURAL STEEL FOR MACHINES

[75] Inventors: Tetsuro Itoh, Tokai; Tetsuo Takahashi, Nagoya; Atsuyoshi Kimura, Aichi; Seiichi Yamano, Tokai, all of Japan

[73] Assignee: Daido Tokushuko Kabushiki Kaisha, Nagoya, Japan

[21] Appl. No.: 761,954

[22] Filed: Jan. 24, 1977

Related U.S. Application Data

[63] Continuation of Ser. No. 523,446, Nov. 13, 1974, abandoned.

[30] Foreign Application Priority Data

Nov. 13, 1973 [JP] Japan ..... 48/127478

[51] Int. Cl.[2] ..... C22C 38/60

[52] U.S. Cl. ..... 75/128 P; 75/123 F; 75/123 G; 75/123 R; 75/126 G; 75/126 L; 75/126 R; 75/128 E; 75/128 R; 148/36

[58] Field of Search ..... 75/123 R, 123 F, 123 G, 75/123 J, 123 K, 123 L, 126 R, 126 G, 126 L; 148/36; 78/128 P, 128 R, 128 E

[56] References Cited

U.S. PATENT DOCUMENTS

| | | | |
|---|---|---|---|
| 3,630,723 | 12/1971 | Asuda | 75/123 R |
| 3,634,074 | 1/1972 | Ito et al. | 75/126 G |
| 3,652,267 | 3/1972 | Ito et al. | 75/123 L |
| 3,844,773 | 10/1974 | Yamakoshi et al. | 75/123 G |
| 3,948,649 | 4/1976 | Takahashi et al. | 75/123 J |

FOREIGN PATENT DOCUMENTS

| | | | |
|---|---|---|---|
| 1,049,917 | 11/1966 | United Kingdom | 75/123 R |

OTHER PUBLICATIONS

Archiv fur das Eisenhuttenwesen, 33 Jahrgang Heft 12, Dec. 1962, pp. 841–851.

Journal of the Iron and Steel Institute, Oct. 1965, pp. 995–997.

*Primary Examiner*—Arthur J. Steiner

*Attorney, Agent, or Firm*—Brisebois & Kruger

[57] ABSTRACT

The present invention relates to a free-cutting structural steel for machines characterized by containing a range of 30–100 g/steel ton of oxide inclusions mainly composed of $SiO_2$ 40–60%, CaO 13–30% and $Al_2O_3$ 25–40%, the balance being less than 20% of other oxides and calcium 0.0002–0.0010%, and at least one of the following elements; lead 0.03–0.30% and sulfur 0.035–0.10%.

5 Claims, 4 Drawing Figures

FREE-CUTTING STRUCTURAL STEEL FOR MACHINES

This is a continuation of application Ser. No. 523,446 filed Nov. 13, 1974 now abandoned.

FIELD OF THE INVENTION

The present invention relates to a free-cutting structural steel for machines with material strengths equal to those of the base composition steel.

DESCRIPTION OF THE PRIOR ART

Recently various new grades of steel are being developed to meet an increasing demand for structural carbon steels for machines, of excellent machinability and excellent cold-forgeability which contain calcium alone or calcium together with lead, sulfur, selenium or tellurium and for structural alloy steels of chromium base, nickel-chromium base, chromium-molybdenum base, or nickel-chromium-molybdenum base.

The reason for the excellent machinability of this type of calcium-containing free-cutting steels is presumed to be as follows:

At the interface between the cemented carbide tool and the chips in high-speed cutting, the oxide inclusions in the steel are softened by the cutting heat, turned semi-molten and forming a deposit ("belag" formation) on the surface of the tool, they prevents the tool wear and prolongs the tool life.

Therefore to secure the best machinability in high-speed cutting, it is necessary to adjust the composition and proportions of the oxide inclusions in the steel, depending on the grade of the steel and the cutting conditions.

Examination of the material strengths of the free-cutting steels containing the elements for improving the machinability shows that the tensile strength and the yield strength of a free-cutting steel containing at least either Pb or S together with Ca are practically no different from those of the base composition steel in both the longitudinal and the transverse direction (relative to the rolling direction), but the elongation and the reduction of area of the free-cutting steel (particularly one of Ca-Pb system), notably in the transverse direction, are considerably inferior to those of the base composition steel. As for the impact value, the rotating-bending fatigue strength and the rolling fatigue strength, the free-cutting steel is invariably inferior to the base composition steel. Thus the mechanical properties of the free-cutting steel are lower than those of the base composition steel. Therefore in using the free-cutting steel, this inferiority in the mechanical properties must be taken into account.

SUMMARY OF THE INVENTION

The object of the present invention is to provide a free-cutting steel of the same level in mechanical properties as the base composition steel. Another object of the present invention is to provide a free-cutting steel characterized by little variance in the mechanical properties and machinability.

These objects of the present invention can be attained by a free-cutting structural steel for machines which contains 30–100 g/steel ton of oxide inclusions mainly composed of $SiO_2$ 40–60%, CaO 13–30% and $Al_2O_3$ 25–40%, the balance being less than 20% of other oxides and calcium 0.0002–0.0010%, and at least one of the following, i.e., lead 0.03–0.30% and sulfur 0.035–0.10%.

DETAILED DESCRIPTION OF PREFERRED EMBODIMENTS

Figure 1:
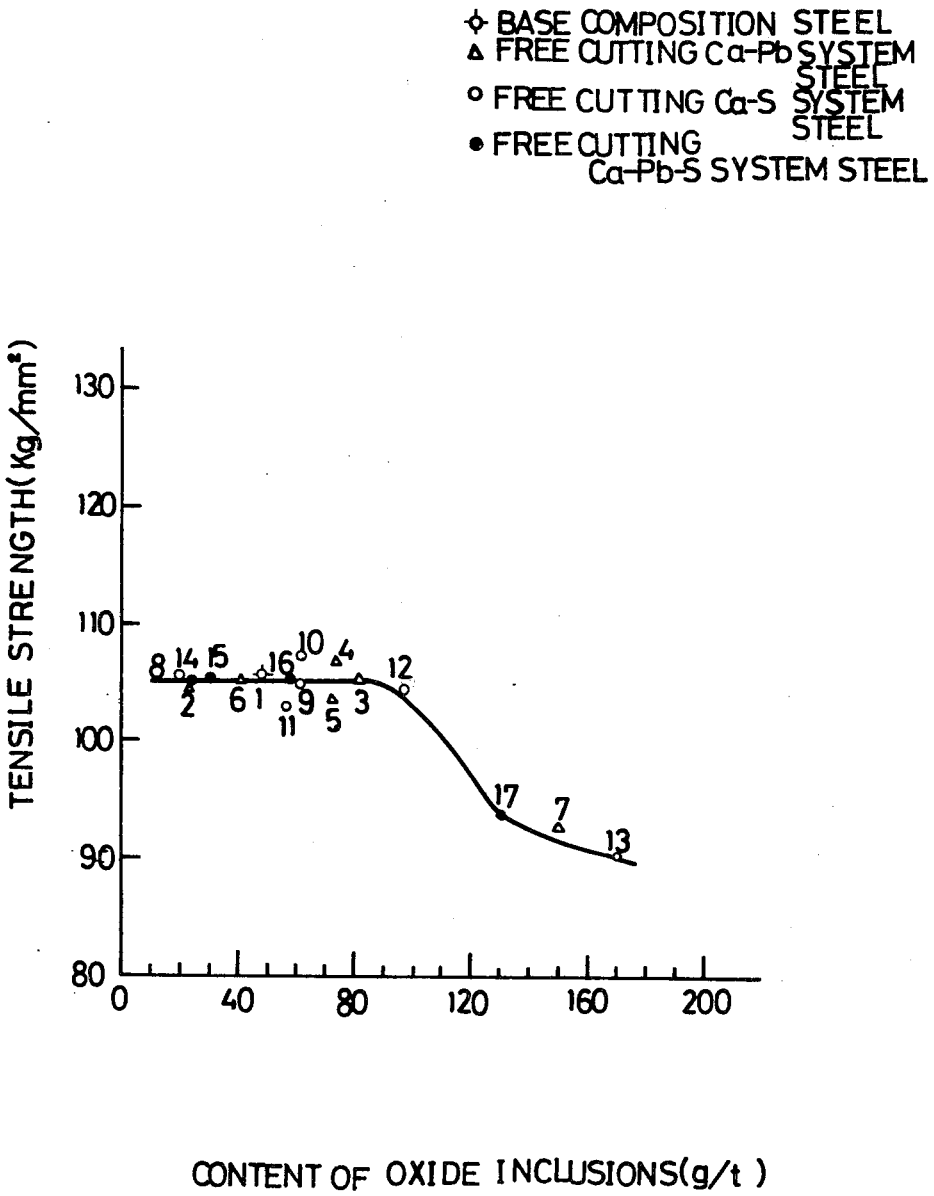
FIG. 1 shows the relation between the tensile strength and the content of oxide inclusions in JIS-S48C system steel tested.

The present invention broadly covers structural carbon steels for machines characterized by containing oxide inclusions mainly composed of $SiO_2$ 40–60%, CaO 13–30% and $Al_2O_3$ 25–40%, the balance being less than 20% of other oxides (for instance, MnO, MgO, FeO) in the range of 30–100 g/steel ton and calcium 0.0002–0.0010%, and at least one of the following: lead 0.03–0.30%, sulfur 0.035–0.10% and a preferred embodiment of the present invention is that it contains oxide inclusions mainly composed of $SiO_2$ 40–60%, CaO 13–30% and $Al_2O_3$ 25–40%, the balance being less than 15% of other oxides (for instance MnO, MgO, FeO) in the range of 30–100 g/steel ton, and further contains calcium 0.0002–0.0010%, and at least one of the following: lead 0.05–0.25% and sulfur 0.04–0.07%.

As the base composition steel, preferred steels are structural carbon steels for machines containing carbon 0.05–0.65%, silicon 0.10–0.40% and manganese 0.25–1.70%, the balance being impurities or iron, or structural alloy steels for machines additionally containing at least one of the following: nickel 0.30–4.50%, chromium 0.15–3.50% and molybdenum 0.08–1.0%.

In the steels of the present invention, as the proportions of the oxides such as MnO, MgO, FeO which are other than the main components ($SiO_2$, CaO, $Al_2O_3$) of the oxide inclusions exceed 15%, especially 20%, the melting point of the inclusions becomes too low and in consequence the "belag" which is effective for improving the machinability (or tool life) in cutting fails to be deposited on the tool surface. Meanwhile, the controllability by the routine melting technique requires that the total amount of the main components in the oxide inclusions be at least 80%, preferably 85%.

On the other hand, if in high-speed cutting with a cemented carbide tool the tool life is to be prolonged, it will be effective to adjust the ratio of the melting point of oxide inclusions to the mean tool tip temperature in cutting to be about 1.7. Therefore, when the mean tool tip temperature is around 800°–900° C., the oxide inclusions must have a melting point of about 1,200°–1,600° C. From this it follows that the proportions of the main components in the oxide inclusions in steel are necessary to be fixed at $SiO_2$ 40–60%, CaO 13–30% and $Al_2O_3$ 25– 40%. For the purpose of securing the material strengths at least equal to those of the base composition steel without deteriorating the machinability, the content of the oxide inclusions is set in the range of 30–100 g/steel ton.

Contents of Ca, Pb and/or S as specified in the steels of the present invention aim at assurance of good machinability.

Namely, Ca has an effect of restraining the tool wear when the steel of the present invention is high-speed cut with a cemented carbide tool, but too much of Ca content decreases the material strengths of the steel. Thus, when the prevention of the tool wear and the material strengths of the steel are taken into consideration, the Ca-content is preferably 0.0002–0.0010%.

Pb has a great effect of improving the chip-breakability in low-speed cutting with a high-speed tool. But, it is not advisable that too much of its addition is made since it deteriorates the material strengths. Therefore, the Pb-content is preferred to be in the range of 0.03–0.30% further preferably in the range of 0.05–0.25%.

S has a similar effect to Pb, but exceeding 0.10%, it tends more strongly to lower the material strengths and accordingly its content is preferred to be in the range of 0.035–0.10% more preferably in the range of 0.04–0.07%. The chip-breakability is most enhanced when Ca, Pb and S are contained in the specified ranges.

The features of the present invention will be more apparent by referring to the following embodiments. In these embodiments, the steel was melted and refined in a basic arc furnace for experimental use; and a deoxidizing alloy of Ca-Si system and a metal alloy containing Pb and S, whereby the oxide inclusions adjusted to make specified alloy proportions were retained in a specified range (30–100 g/steel ton), were added to the molten steel, when or after it was discharged out of the furnace; and then by the routine method the steel was made into an ingot, hotrolled and thereafter various samples were taken therefrom.

Example of embodiment 1 (JIS-S48C structural carbon steel for machines).

Figure 2:
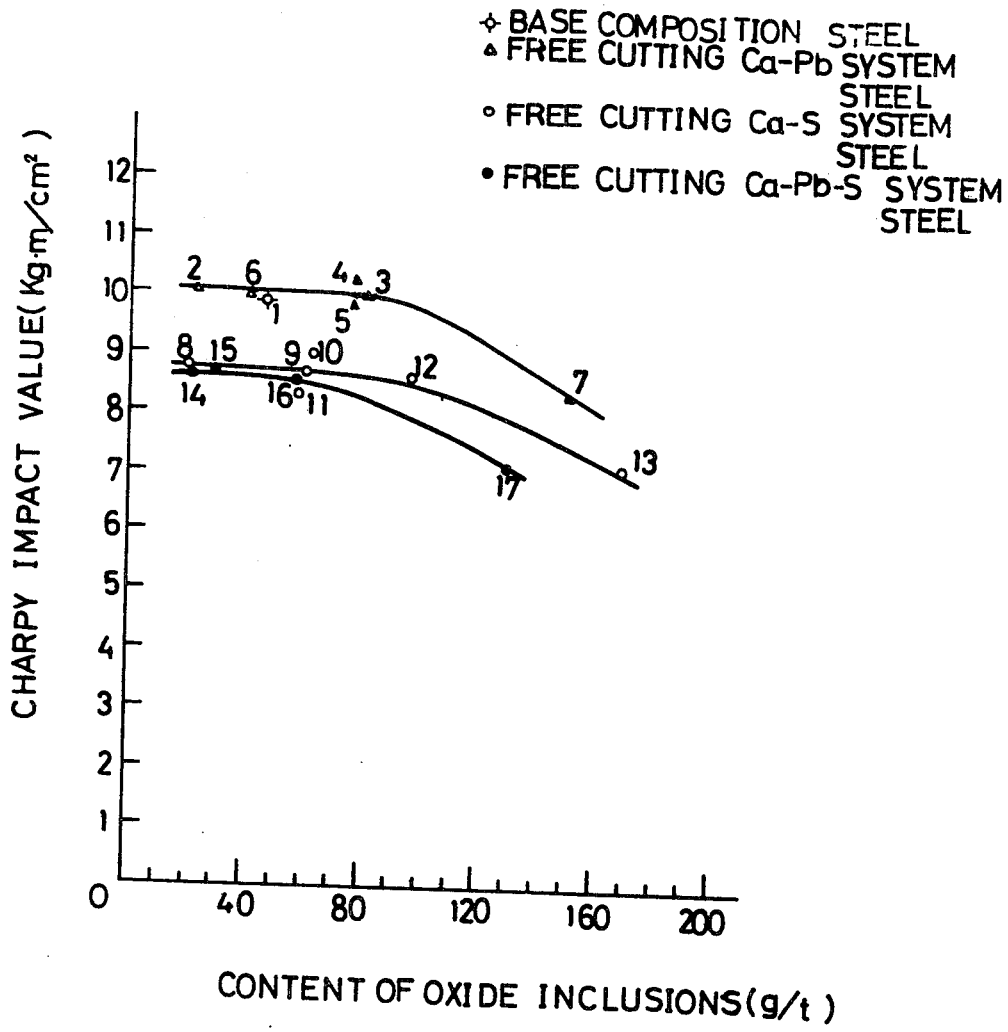
FIG. 2 shows the relation between the Charpy impact value and the content of oxide inclusions in JIS-S48C system steel tested.

For JIS-S48C (SAE-1045) steel of the composition as listed in Table 1, the relation between the tensile strength and the content of $SiO_2$-CaO-$Al_2O_3$ oxide inclusions in a sample which has been quenched and tempered (850° COQ, 550° CWT) is illustrated in FIG. 1, from which it is seen that while the content is less than 100 g/steel ton, the tensile strength can be retained as high as that of the base composition steel (S48CN) (about 90 kg/mm$^3$), but when it exceeds 100 g/steel ton, the strength tends to drop sharpy. As illustrated in FIG. 2, the Charpy impact value follows approximately the same tendency as the tensile strength. Both the tensile strength and the charpy impact value are more or less affected by variations in the contents of Pb and S, but substantially they remain the same.

Table 1

| | | | | | | | | | | Oxide inclusions (%) | | | | | | |
|---|---|---|---|---|---|---|---|---|---|---|---|---|---|---|---|---|
| No. | C | Si | Mn | P | S | Ni | Cr | Ca | Pb | $SiO_2$ | $C_2O$ | $Al_2O_3$ | Others | $SiO_2$+ CaO+ $Al_2O_3$ | Inclusion(g/ steel ton) | Remark |
| 1 | 0.48 | 0.28 | 0.70 | 0.011 | 0.012 | 0.08 | 0.04 | <0.0002 | — | 1 | 2 | 95 | 2 | 98 | 45 | Base composition steel |
| 2 | 0.48 | 0.30 | 0.73 | 0.010 | 0.012 | 0.08 | 0.05 | <0.0002 | 0.18 | 51 | 10 | 27 | 12 | 88 | 21 | Free-cutting |
| 3 | 0.47 | 0.30 | 0.68 | 0.015 | 0.013 | 0.10 | 0.08 | 0.0005 | 0.19 | 54 | 18 | 25 | 3 | 97 | 80 | Ca-Pb |
| 4 | 0.47 | 0.27 | 0.67 | 0.013 | 0.014 | 0.09 | 0.06 | 0.0004 | 0.08 | 48 | 15 | 31 | 6 | 94 | 76 | system |
| 5 | 0.49 | 0.28 | 0.72 | 0.014 | 0.012 | 0.10 | 0.07 | 0.0004 | 0.26 | 46 | 17 | 29 | 8 | 92 | 75 | steel |
| 6 | 0.49 | 0.31 | 0.71 | 0.014 | 0.014 | 0.08 | 0.09 | 0.0003 | 0.17 | 47 | 13 | 33 | 7 | 93 | 40 | |
| 7 | 0.48 | 0.28 | 0.73 | 0.010 | 0.015 | 0.08 | 0.09 | 0.0004 | 0.20 | 30 | 12 | 53 | 5 | 95 | 150 | |
| 8 | 0.48 | 0.31 | 0.72 | 0.008 | 0.065 | 0.09 | 0.04 | <0.0002 | — | 38 | 12 | 37 | 13 | 87 | 20 | Free-cutting |
| 9 | 0.47 | 0.29 | 0.73 | 0.010 | 0.065 | 0.08 | 0.07 | 0.0004 | — | 49 | 18 | 28 | 5 | 95 | 62 | Ca-S |
| 10 | 0.49 | 0.26 | 0.70 | 0.014 | 0.045 | 0.10 | 0.05 | 0.0003 | — | 48 | 15 | 30 | 7 | 93 | 60 | system |
| 11 | 0.46 | 0.29 | 0.67 | 0.013 | 0.092 | 0.07 | 0.05 | 0.0003 | — | 46 | 17 | 30 | 7 | 93 | 58 | steel |
| 12 | 0.48 | 0.29 | 0.67 | 0.013 | 0.092 | 0.07 | 0.05 | 0.0003 | — | 46 | 26 | 27 | 6 | 94 | 97 | |
| 13 | 0.48 | 0.20 | 0.67 | 0.011 | 0.062 | 0.10 | 0.05 | 0.0031 | — | 21 | 35 | 40 | 4 | 96 | 170 | |
| 14 | 0.49 | 0.28 | 0.75 | 0.012 | 0.056 | 0.13 | 0.05 | <0.0002 | 0.16 | 48 | 5 | 38 | 10 | 90 | 23 | Free-cutting |
| 15 | 0.47 | 0.31 | 0.72 | 0.009 | 0.051 | 0.08 | 0.11 | 0.0006 | 0.19 | 49 | 17 | 26 | 8 | 92 | 30 | Ca-Pb-S |
| 16 | 0.49 | 0.29 | 0.70 | 0.011 | 0.064 | 0.11 | 0.09 | 0.0008 | 0.13 | 40 | 15 | 27 | 18 | 82 | 57 | system |
| 17 | 0.50 | 0.27 | 0.68 | 0.014 | 0.060 | 0.09 | 0.07 | 0.0028 | 0.18 | 39 | 26 | 18 | 17 | 83 | 130 | steel |

Figure 3:
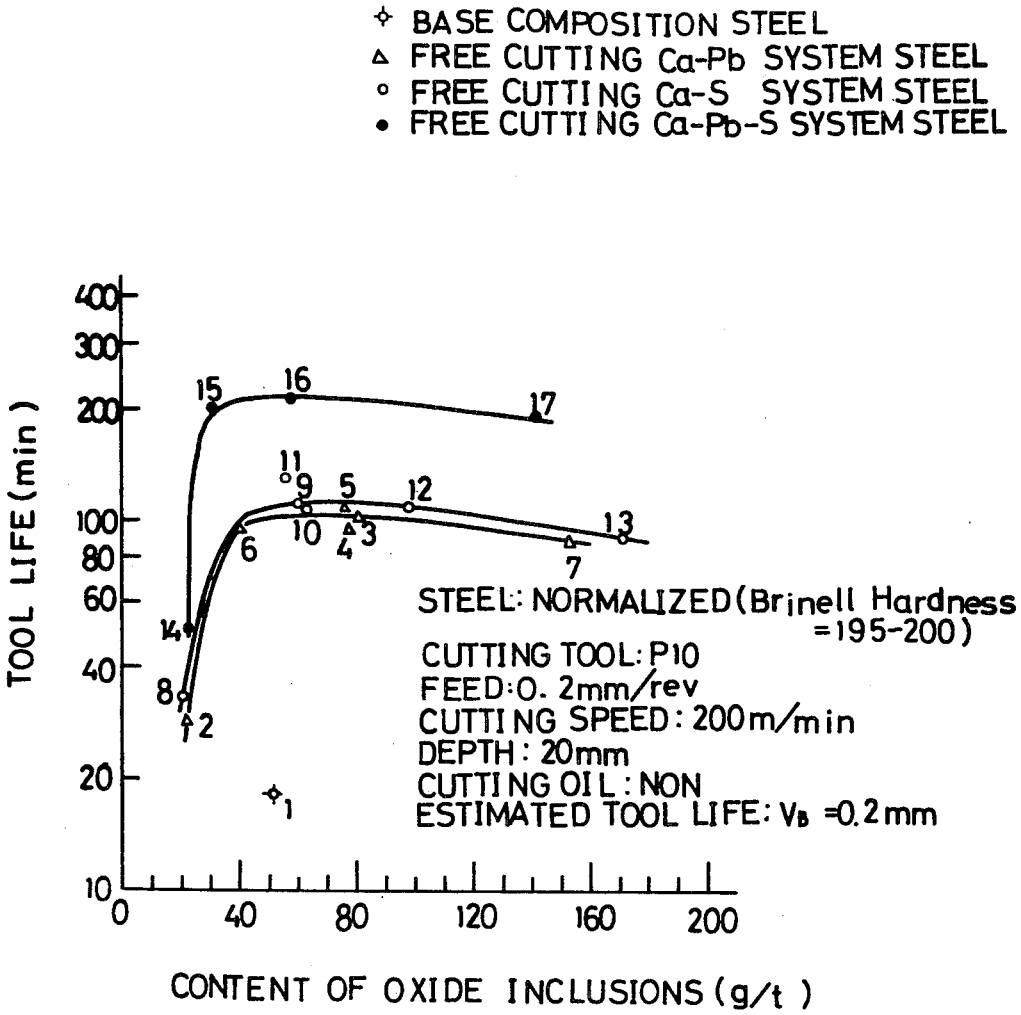
FIG. 3 shows the relation between the tool life and the content of oxide inclusions in JIS-S48C system steel which has been turned by a cemented carbide tool.
Figure 4:
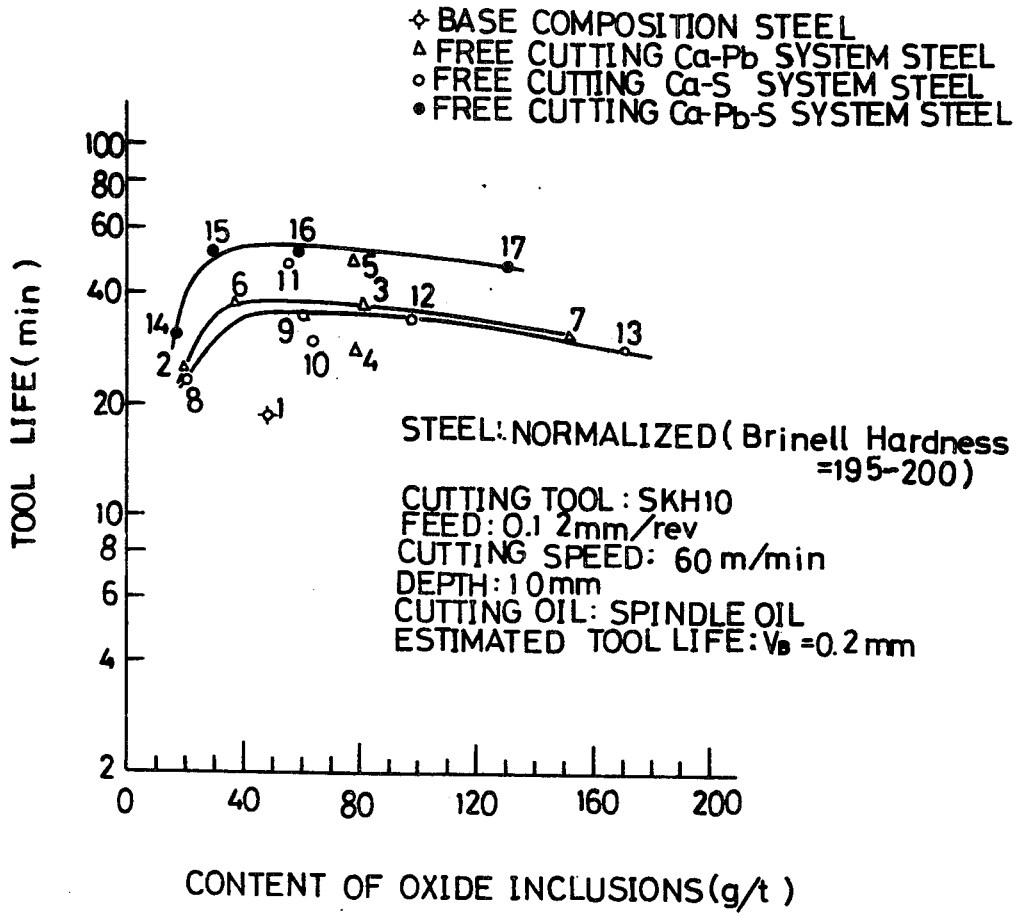
FIG. 4 shows the relation between the tool life and the content of oxide inclusions in JIS-S48C system steel which has been turned by a high-speed cutting tool.

Meanwhile samples adjusted to about equal hardness through normalizing treatment (900° CAC) were turned using a cemented carbide tool and a high-speed cutting tool and thereby the machinabilities (tool life) of these samples are respectively indicated in FIGS. 3 and 4, from which it is seen that in both samples the machinability is better than that of the base composition steel, but it becomes poor when the content of oxide inclusions is less than 30 g/steel ton; when the content ranges from 30 to 100 g/steel ton, excellent machinability is exhibited. However, when the content exceeds 100 g/steel ton, the machinability tends to drop steadily.

Thus the preferable content of oxide inclusions for JIS-S48C steels of the present invention to be able to exhibit as high material strengths and machinability as the base composition steel has been confirmed to be 30–100 g/steel ton. The effects of Pb and S on cutting by a cemented carbide tool are not found so remarkable, but their effects on cutting by a high-speed tool are remarkable.

EXAMPLE OF EMBODIMENT 2

Table 2 lists the chemical composition of the samples tested in this example, and the proportions and contents of $SiO_2$, CaO and $Al_2O_3$ and other oxide inclusions. Table 3 lists the tensile strength, Charpy impact value of heat-treated samples; and the tool life in the same cutting test as in Example 1 using a cemented carbide tool and a high-speed tool. Table 4 lists the heat-treating conditions for various samples. Table 5 lists the cutting conditions in the cutting tests.

As seen from Table 3, all steels exhibit the same trend as in Example 1, testifying to the superiority of the Ca-Pb and/or S system free-cutting steels of the present invention to the conventional one.

Table 2

| Steel | Mark | Chemical composition (%) C | Si | Mn | P | S | Ni | Cr | Mo | Ca | Pb | Oxide inclusion (%) $SiO_2$ | CaO | $Al_2O_3$ | Others | $SiO_2$+CaO+$Al_2O_3$ | Inclusion (g/steel ton) |
|---|---|---|---|---|---|---|---|---|---|---|---|---|---|---|---|---|---|
| JIS-S200 | N | 0.19 | 0.26 | 0.68 | 0.008 | 0.012 | 0.05 | 0.09 | — | <0.0002 | — | 2 | 2 | 93 | 3 | 97 | 65 |
| (SAE- | YF-A | 0.19 | 0.28 | 0.70 | 0.010 | 0.015 | 0.06 | 0.05 | — | 0.0007 | 0.20 | 51 | 18 | 27 | 4 | 96 | 47 |
| 1020 | YF-B | 0.20 | 0.28 | 0.70 | 0.010 | 0.012 | 0.05 | 0.06 | — | 0.0058 | 0.18 | 30 | 42 | 24 | 4 | 96 | 105 |
| | YS-A | 0.21 | 0.31 | 0.69 | 0.013 | 0.058 | 0.05 | 0.07 | — | 0.0008 | — | 45 | 21 | 30 | 4 | 96 | 58 |
| | YS-B | 0.18 | 0.29 | 0.71 | 0.016 | 0.060 | 0.07 | 0.07 | — | 0.0045 | — | 37 | 31 | 22 | 10 | 90 | 145 |
| | YFS-A | 0.20 | 0.29 | 0.70 | 0.015 | 0.061 | 0.07 | 0.06 | — | 0.0004 | 0.21 | 48 | 16 | 31 | 5 | 95 | 80 |
| | YFS-B | 0.21 | 0.30 | 0.69 | 0.014 | 0.058 | 0.06 | 0.08 | — | 0.0043 | 0.19 | 38 | 28 | 29 | 5 | 95 | 180 |
| JIS- | N | 0.38 | 0.28 | 0.73 | 0.006 | 0.018 | 0.07 | 0.08 | — | <0.0002 | — | 3 | 1 | 92 | 4 | 96 | 78 |
| SMn2 | YF-A | 0.39 | 0.25 | 0.71 | 0.012 | 0.015 | 0.07 | 0.07 | — | 0.0006 | 0.17 | 52 | 16 | 28 | 4 | 96 | 61 |
| (SAE- | YF-B | 0.37 | 0.26 | 0.68 | 0.007 | 0.015 | 0.06 | 0.08 | — | 0.0062 | 0.19 | 36 | 32 | 23 | 9 | 91 | 162 |
| 1541) | YS-A | 0.36 | 0.29 | 0.73 | 0.008 | 0.069 | 0.10 | 0.05 | — | 0.0004 | — | 46 | 19 | 27 | 8 | 92 | 78 |
| | YS-B | 0.37 | 0.28 | 0.71 | 0.011 | 0.078 | 0.08 | 0.06 | — | 0.0041 | — | 39 | 28 | 21 | 12 | 88 | 128 |
| | YFS-A | 0.40 | 0.23 | 0.70 | 0.010 | 0.055 | 0.11 | 0.08 | — | 0.0005 | 0.21 | 45 | 18 | 29 | 8 | 92 | 49 |
| | YFS-B | 0.36 | 0.25 | 0.70 | 0.009 | 0.074 | 0.10 | 0.06 | — | 0.0051 | 0.18 | 37 | 32 | 23 | 8 | 92 | 131 |
| JIS- | N | 0.36 | 0.27 | 0.73 | 0.006 | 0.018 | 0.07 | 1.01 | — | <0.0002 | — | 4 | 1 | 96 | 5 | 95 | 60 |
| $SCr_3$ | YF-A | 0.39 | 0.26 | 0.71 | 0.012 | 0.015 | 0.07 | 1.03 | — | 0.0005 | 0.20 | 48 | 15 | 26 | 11 | 89 | 40 |
| (SAE- | YF-B | 0.35 | 0.29 | 0.68 | 0.007 | 0.015 | 0.06 | 1.00 | — | 0.0048 | 0.13 | 35 | 31 | 26 | 9 | 91 | 110 |
| 5135) | YS-A | 0.35 | 0.27 | 0.73 | 0.008 | 0.067 | 0.10 | 0.99 | — | 0.0006 | | 50 | 17 | 26 | 7 | 93 | 50 |
| | YS-B | 0.36 | 0.30 | 0.71 | 0.011 | 0.078 | 0.08 | 1.05 | — | 0.0050 | — | 31 | 32 | 31 | 6 | 94 | 160 |
| | YFS-A | 0.35 | 0.28 | 0.70 | 0.010 | 0.042 | 0.11 | 0.98 | — | 0.004 | 0.21 | 47 | 19 | 27 | 7 | 93 | 75 |
| | YFS-B | 0.36 | 0.26 | 0.70 | 0.009 | 0.074 | 0.10 | 1.03 | — | 0.0046 | 0.19 | 33 | 28 | 35 | 4 | 96 | 135 |
| JIS- | N | 0.34 | 0.27 | 0.64 | 0.011 | 0.016 | 1.26 | 0.71 | — | <0.0002 | — | 1 | 2 | 93 | 4 | 96 | 78 |
| SNCl | YF-A | 0.35 | 0.29 | 0.70 | 0.013 | 0.017 | 1.27 | 0.72 | — | 0.0004 | 0.18 | 48 | 21 | 27 | 4 | 96 | 35 |
| (Ni-Cr | YF-B | 0.31 | 0.27 | 0.70 | 0.010 | 0.015 | 1.25 | 0.70 | — | 0.0065 | 0.18 | 28 | 36 | 25 | 11 | 89 | 105 |
| steel) | YS-A | 0.33 | 0.30 | 0.71 | 0.008 | 0.050 | 1.28 | 0.68 | — | 0.0003 | — | 46 | 19 | 31 | 4 | 96 | 45 |
| | YS-B | 0.35 | 0.28 | 0.68 | 0.012 | 0.050 | 1.29 | 0.69 | — | 0.0048 | — | 27 | 35 | 28 | 10 | 90 | 148 |
| | YFS-A | 0.32 | 0.27 | 0.69 | 0.010 | 0.063 | 1.25 | 0.68 | — | 0.0002 | 0.18 | 46 | 20 | 29 | 5 | 95 | 80 |
| | YFS-B | 0.33 | 0.30 | 0.70 | 0.009 | 0.061 | 1.28 | 0.70 | — | 0.0025 | 0.19 | 27 | 32 | 31 | 10 | 90 | 165 |
| JIS- | N | 0.34 | 0.26 | 0.73 | 0.008 | 0.016 | 1.80 | 0.90 | 0.91 | <0.0002 | — | 3 | 2 | 90 | 5 | 95 | 65 |
| SNCMl | YF-A | 0.31 | 0.27 | 0.70 | 0.010 | 0.016 | 1.81 | 0.91 | 0.23 | 0.0006 | 0.16 | 46 | 21 | 27 | 6 | 94 | 40 |
| (Ni-Cr- | YF-B | 0.31 | 0.28 | 0.68 | 0.012 | 0.018 | 1.81 | 0.90 | 0.19 | 0.0045 | 0.20 | 30 | 28 | 28 | 14 | 86 | 120 |
| Mo | YS-A | 0.32 | 0.29 | 0.73 | 0.007 | 0.065 | 1.78 | 0.87 | 0.19 | 0.0004 | — | 48 | 20 | 27 | 5 | 95 | 35 |
| steel) | YS-B | 0.30 | 0.25 | 0.65 | 0.008 | 0.070 | 1.80 | 0.92 | 0.24 | 0.0040 | — | 31 | 29 | 29 | 11 | 89 | 145 |
| | YFS-A | 0.33 | 0.28 | 0.71 | 0.009 | 0.070 | 1.75 | 0.90 | 0.22 | 0.0005 | 0.18 | 49 | 19 | 28 | 4 | 96 | 80 |
| | YFS-B | 0.32 | 0.27 | 0.67 | 0.011 | 0.065 | 1.79 | 0.88 | 0.21 | 0.0050 | 0.16 | 33 | 29 | 27 | 11 | 89 | 150 |
| JIS- | N | 0.37 | 0.33 | 0.75 | 0.016 | 0.015 | 0.05 | 1.03 | 0.18 | <0.0002 | — | 2 | 1 | 94 | 3 | 97 | 65 |
| SCM3 | YF-A | 0.37 | 0.35 | 0.76 | 0.013 | 0.011 | 0.07 | 1.00 | 0.18 | 0.0008 | 0.17 | 41 | 25 | 28 | 6 | 94 | 63 |
| (SAE- | YF-B | 0.38 | 0.34 | 0.73 | 0.012 | 0.012 | 0.08 | 1.02 | 0.17 | 0.0035 | 0.16 | 25 | 34 | 40 | 1 | 99 | 140 |
| 4135) | YS-A | 0.36 | 0.33 | 0.77 | 0.0910 | 0.042 | 0.10 | 1.00 | 0.17 | 0.0004 | — | 48 | 19 | 25 | 8 | 92 | 45 |
| | YS-B | 0.37 | 0.35 | 0.73 | 0.014 | 0.095 | 0.10 | 1.07 | 0.18 | 0.0048 | — | 34 | 20 | 39 | 7 | 93 | 170 |
| | YFS-A | 0.36 | 0.30 | 0.75 | 0.013 | 0.061 | 0.11 | 1.04 | 0.18 | 0.0009 | 0.17 | 41 | 18 | 31 | 10 | 90 | 90 |
| | YFS-B | 0.35 | 0.34 | 0.79 | 0.012 | 0.065 | 0.11 | 1.02 | 0.15 | 0.0041 | 0.14 | 24 | 20 | 48 | 8 | 92 | 168 |
| JIS- | N | 0.44 | 0.28 | 1.46 | 0.018 | 0.013 | 0.06 | 0.54 | — | <0.0002 | — | 3 | 1 | 91 | 5 | 95 | 62 |
| SMnC3 | YF-A | 0.41 | 0.25 | 1.51 | 0.016 | 0.011 | 0.07 | 0.55 | — | 0.0007 | 0.18 | 52 | 16 | 26 | 6 | 94 | 53 |
| (Mn-Cr | YF-B | 0.43 | 0.21 | 1.42 | 0.013 | 0.014 | 0.08 | 0.48 | — | 0.0038 | 0.20 | 37 | 30 | 23 | 10 | 90 | 153 |
| steel) | YS-A | 0.40 | 0.30 | 1.58 | 0.014 | 0.048 | 0.07 | 0.50 | — | 0.0006 | — | 50 | 17 | 25 | 8 | 92 | 89 |
| | YS-B | 0.45 | 0.30 | 1.56 | 0.013 | 0.051 | 0.09 | 0.52 | — | 0.0041 | — | 37 | 32 | 24 | 7 | 93 | 128 |
| | YFS-A | 0.44 | 0.24 | 1.41 | 0.012 | 0.062 | 0.05 | 0.42 | — | 0.0003 | 0.17 | 48 | 19 | 26 | 7 | 93 | 42 |
| | YFS-B | 0.41 | 0.26 | 1.43 | 0.014 | 0.064 | 0.07 | 0.44 | — | 0.0045 | 0.16 | 36 | 32 | 25 | 7 | 93 | 133 |
| SAE- | N | 0.34 | 0.29 | 0.73 | 0.019 | 0.018 | 0.05 | 0.09 | 0.23 | <0.0002 | — | 2 | 2 | 89 | 7 | 93 | 70 |
| 4032 | YF-A | 0.32 | 0.31 | 0.78 | 0.020 | 0.019 | 0.08 | 0.10 | 0.22 | 0.0008 | 0.15 | 49 | 17 | 29 | 5 | 95 | 68 |
| (Mo | YF-B | 0.32 | 0.26 | 0.81 | 0.018 | 0.017 | 0.07 | 0.08 | 0.22 | 0.0041 | 0.14 | 36 | 28 | 28 | 8 | 92 | 136 |
| steel) | YS-A | 0.31 | 0.28 | 0.76 | 0.021 | 0.063 | 0.05 | 0.26 | 0.0003 | — | 47 | 15 | 32 | 6 | 94 | 96 | |
| | YS-B | 0.33 | 0.29 | 0.75 | 0.023 | 0.058 | 0.06 | 0.08 | 0.25 | 0.0049 | — | 35 | 29 | 29 | 7 | 93 | 148 |
| | YFS-A | 0.35 | 0.32 | 0.81 | 0.016 | 0.049 | 0.09 | 0.07 | 0.27 | 0.0005 | 0.16 | 48 | 18 | 27 | 7 | 93 | 62 |
| | YFS-B | 0.33 | 0.31 | 0.82 | 0.015 | 0.050 | 0.07 | 0.07 | 0.24 | 0.0039 | 0.17 | 37 | 27 | 28 | 8 | 92 | 128 |
| SAE- | N | 0.21 | 0.25 | 0.72 | 0.015 | 0.017 | 1.79 | 0.11 | 0.22 | <0.0002 | — | 3 | 2 | 88 | 7 | 93 | 78 |
| 4621 | YF-A | 0.18 | 0.28 | 0.71 | 0.018 | 0.016 | 1.76 | 0.09 | 0.24 | 0.0008 | 0.16 | 46 | 18 | 27 | 9 | 91 | 78 |
| (Ni-Mo | YF-B | 0.19 | 0.27 | 0.72 | 0.016 | 0.016 | 1.73 | 0.10 | 0.24 | 0.0082 | 0.18 | 35 | 28 | 28 | 9 | 91 | 161 |
| steel) | YS-A | 0.22 | 0.29 | 0.71 | 0.015 | 0.058 | 1.78 | 0.07 | 0.27 | 0.0005 | — | 48 | 18 | 26 | 8 | 92 | 60 |
| | YS-B | 0.21 | 0.31 | 0.73 | 0.017 | 0.061 | 1.76 | 0.08 | 0.26 | 0.0050 | — | 31 | 28 | 35 | 6 | 94 | 127 |
| | YFS-A | 0.20 | 0.26 | 0.71 | 0.014 | 0.051 | 1.73 | 0.08 | 0.25 | 0.0006 | 0.13 | 45 | 20 | 29 | 6 | 94 | 63 |
| | YFS-B | 0.20 | 0.30 | 0.70 | 0.016 | 0.050 | 1.69 | 0.10 | 0.23 | 0.0045 | 0.12 | 32 | 27 | 33 | 8 | 92 | 133 |

Note 1) Marks
N : Base composition steel
YF : Free-cutting Ca-Pb system steel
YS : Free-cutting Ca-S system steel
YFS: Free-cutting Ca-Pb-S system steel
-A : Invented steel
-B : Conventional steel Table 3

| Steel | Marks | Mechanical properties: Tensile strength Kg/mm² | Charpy impact value Kg.m/cm² | Tool life: Cemented carbide tool (min) | High speed cutting tool (min) |
|---|---|---|---|---|---|
| JIS- | N | 51.2 | 25.3 | 15 | 150 |
| SMC | YF-A | 50.2 | 24.9 | 150 | 480 |
| (SAE- | YF-B | 48.6 | 22.0 | 150 | 460 |
| 1329) | YS-A | 48.2 | 20.3 | 140 | 400 |
| | YS-B | 46.3 | 18.3 | 130 | 390 |
| | YFS-A | 47.7 | 23.2 | 200 | 600 |

Table 3-continued

| Steel | Marks | Mechanical properties: Tensile strength Kg/mm² | Charpy impact value Kg.m/cm² | Tool life: Cemented carbide tool (min) | High speed cutting tool (min) |
|---|---|---|---|---|---|
| | YFS-B | 45.8 | 17.8 | 180 | 540 |
| JIS- | N | 83.5 | 11.5 | — | 20 |
| SMn2 | YF-A | 53.6 | 11.7 | 40 | 100 |
| (SAE- | YF-B | 82.8 | 11.3 | 63 | 83 |
| 2541) | YS-A | 81.5 | 9.2 | 73 | 75 |
| | YS-B | 81.9 | 9.3 | 90 | 70 |

Table 3-continued

| Steel | Marks | Mechanical properties: Tensile strength Kg/mm² | Mechanical properties: Charpy impact value Kg.m/cm² | Tool life: Cemented carbide tool (min) | Tool life: High speed cutting tool (min) |
|---|---|---|---|---|---|
| | YFS-A | 82.5 | 9.4 | 105 | 135 |
| | YFS-B | 82.1 | 9.2 | 130 | 115 |
| JIS- | N | 115.2 | 12.1 | 20 | 30 |
| SCr3 | YF-A | 114.9 | 12.2 | 20 | 180 |
| (SAE- | YF-B | 113.0 | 11.1 | 70 | 160 |
| 535) | YS-A | 111.3 | 11.2 | 68 | 200 |
| | YS-B | 97.3 | 9.6 | 65 | 170 |
| | YFS-A | 111.1 | 10.9 | 110 | 350 |
| | YFS-B | 96.4 | 8.7 | 105 | 300 |
| JIS- | N | 90.3 | 17.3 | 10 | 21 |
| SNCl | YF-A | 90.2 | 17.1 | 60 | 85 |
| NiCr | YF-B | 87.3 | 16.2 | 55 | 60 |
| steel) | YS-A | 87.1 | 15.0 | 60 | 70 |
| | YS-B | 85.1 | 13.2 | 50 | 68 |
| | YFS-A | 86.1 | 14.8 | 90 | 110 |
| | YFS-B | 83.2 | 12.8 | 90 | 100 |
| JIS- | N | 98.3 | 10.0 | 5 | 7 |
| SNCM1 | YF-A | 98.4 | 9.9 | 48 | 16 |
| (Ni-Cr | YF-B | 96.8 | 8.5 | 50 | 15 |
| -Mo | YS-A | 95.3 | 7.8 | 42 | 15 |
| steel) | YS-B | 92.3 | 7.0 | 40 | 18 |
| | YFS-A | 95.0 | 7.3 | 56 | 28 |
| | YFS-B | 91.6 | 6.8 | 50 | 25 |
| JIS- | N | 121.0 | 15.9 | 12 | 15 |
| SCM3 | YF-A | 120.8 | 15.9 | 75 | 34 |
| (SAE- | YF-B | 110.5 | 14.3 | 62 | 29 |
| 4135 | YS-A | 120.0 | 14.6 | 52 | 30 |
| | YS-B | 105.3 | 12.9 | 46 | 21 |
| | YFS-A | 119.7 | 14.6 | 108 | 54 |
| | YFS-B | 104.0 | 12.8 | 94 | 45 |
| JIS- | N | 111.3 | 8.4 | 5 | 10 |
| SMnC3 | YF-A | 111.7 | 8.5 | 25 | 32 |
| (Mn-Cr | YF-B | 110.8 | 8.3 | 33 | 28 |
| steel) | YS-A | 108.4 | 7.2 | 35 | 25 |
| | YS-B | 106.5 | 7.0 | 40 | 23 |
| | YFS-A | 108.7 | 7.3 | 53 | 46 |
| | YFS-B | 107.7 | 6.9 | 60 | 41 |
| SAE- | N | 150.2 | 3.8 | 3 | 5 |
| 4032 | YF-A | 149.8 | 4.0 | 18 | 25 |
| (Mo | YF-B | 148.5 | 3.8 | 23 | 22 |
| steel) | YS-A | 147.3 | 3.1 | 25 | 21 |
| | YS-B | 147.0 | 2.8 | 30 | 17 |
| | YFS-A | 146.2 | 3.0 | 33 | 33 |
| | YFS-B | 146.3 | 2.8 | 40 | 31 |
| SAE- | N | 107.3 | 5.8 | 15 | 28 |
| 4621 | YF-A | 108.1 | 5.7 | 48 | 53 |
| (Ni-Mo | YF-B | 107.5 | 5.3 | 50 | 51 |
| steel) | YS-A | 105.2 | 4.8 | 52 | 48 |
| | YS-B | 103.1 | 4.5 | 60 | 40 |
| | YFS-A | 104.1 | 4.7 | 68 | 63 |
| | YFS-B | 103.5 | 4.4 | 73 | 60 |

Table 4

| | Pieces for mechanical properties test | Pieces for cutting test |
|---|---|---|
| JIS-S20C (SAE-1020) | Normalized (900° C. A. C.) | |
| JIS-SMn2 (SAE-1541) | Quenched, Tempered (850° C O.Q., 600° C W.T.) | Normalized (850° C. A. C.) |
| JIS-SCr3 (SAE-5135) | " (850° C O.Q., 600° C W.T.) | Annealed (850° C F.C.) |
| JIS-SNC1 (Ni-Cr Steel) | " (850° C O.Q., 600° C W.T.) | Annealed (850° C F.C.) |
| JIS-SNCM1 (Ni-Cr-Mo Steel) | " (850° C O.Q., 600° C W.T.) | Annealed (850° C F.C.) |
| JIS-SCM3 (SAE-4135) | " (850° C O.Q., 550° C W.T.) | Annealed (850° C F.C.) |
| JIS-SMnC3 (Mn-Cr Steel) | " (850° C O.Q., 600° C W.T.) | Annealed (850° C F.C.) |
| SAE-4032 (Mo Steel) | " (830° C O.Q., 300° C W.T.) | Annealed (830° C F.C.) |
| SAE-4621 (Ni-Mo Steel) | " (830° C O.Q., 150° C W.T.) | Annealed (830° C F.C.) |

Comment
OQ: Oil quenched
WT: Water tempered
AC: Air cooling
FC: Furnace cooling

Table 5

| | Steel | Cutting conditions: Steel hardness | Cutting tool | Feed (mm/rev) | Cutting speed m/min) | Depth (mm) | Cutting oil | Tool life estimated |
|---|---|---|---|---|---|---|---|---|
| Cemented carbide tool cutting | JIS-S20C (SAE-1020) | BHN= 140–145 | JIS-P10 | 0.20 | 200 | 2.0 | none | $V_B=0.3^{mm}$ |
| | JIS-SMn2 (SAE-1541) | BHN= 180–190 | " | " | " | " | " | " |
| | JIS-SCr3 (SAE-5135) | BHN= 180–185 | " | " | " | " | " | " |
| | JIS-SNCl (Ni-Cr steel) | BHN= 205–210 | " | " | " | " | " | " |
| | JIS-SNCM1 (Ni-Cr-Mo steel) | BHN= 260–265 | " | " | " | " | " | " |
| | JIS-SCM3 (SAE-4135) | BHN= 180–185 | " | " | " | " | " | $V_B=0.2^{mm}$ |
| | JIS-SMnC3 (Mn-Cr steel) | BHN= 200–210 | " | " | " | " | " | $V_B=0.3^{mm}$ |
| | SAE-4032 (Mo steel) | BHN= 180–185 | " | " | " | " | " | " |
| | SAE-4621 (Ni-Mo steel) | BHN= 150–160 | " | " | " | " | " | " |
| High speed cutting tool cutting | JIS-S20C (SAE-1020) | BHN= 140–145 | JIS-SKH 57 | 0.12 | 80 | 1.0 | Spindle oil | Tool melt down |
| | JIS-SMn2 (SAE-1541) | BHN= 180–190 | " | " | " | " | " | " |
| | JIS-SCr3 (SAE-5135) | BHN= 180–185 | " | " | " | " | " | " |

Table 5-continued

| Steel | Steel hardness | Cutting conditions: Cutting tool | Feed (mm/rev) | Cutting speed m/min) | Depth (mm) | Cutting oil | Tool life estimated |
|---|---|---|---|---|---|---|---|
| JIS-SNCl (Ni-Cr steel) | BHN= 205–210 | " | " | " | " | " | " |
| JIS-SNCM1 (Ni-Cr-Mo steel) | BHN= 260–265 | " | " | " | " | " | " |
| JIS-SCM3 (SAE-4135) | BHN= 180–185 | JIS-SKH 10 | " | " | " | " | $V_B=0.2^{mm}$ |
| JIS-SMnC3 (Mn-Cr steel) | BHN= 200–210 | JIS-SKH 57 | " | " | " | " | Tool melt down |
| SAE-4032 (Mo steel) | BHN= 180–185 | " | " | " | " | " | " |
| SAE-4621 (Ni-Mo steel) | BHN= 150–160 | " | " | " | " | " | " |

Comment: $V_B$ is the abbreviation for "Flank wear"

What I claim is:

1. Free-cutting structural steel consisting essentially of 0.05–0.65% carbon, 0.10–0.40% silicon, 0.25–1.70% manganese, 0–4.50% nickel, 0–3.50% chromium, 0–1.0% molybdenum, 0.0002–0.0010% calcium and at least one element selected from the group consisting of 0.03–0.30% lead and 0.04–0.10% sulfur by weight, the balance being iron and impurities, together with 30–100 grams of oxide inclusions per ton of steel, said inclusions comprising 40–60% $SiO_2$, 5–30% CaO and 25–40% $Al_2O_3$, with less than 20% of other oxides, said inclusions having a melting point of 1,200°–1,600° C.

2. Steel as claimed in claim 1 in which said oxide inclusions comprise less than 15% of oxides other than CaO, $Al_2O_3$ and $SiO_2$.

3. Steel as claimed in claim 1 in which said selected element is lead.

4. Steel as claimed in claim 1 in which said selected element is sulfur.

5. Steel as claimed in claim 1 which comprises 0.30–4.50% nickel, 0.15–3.50% chromium, and 0.08–1.0% molybdenum.

* * * * *